US007187289B2

(12) United States Patent
Eckstein et al.

(10) Patent No.: US 7,187,289 B2
(45) Date of Patent: Mar. 6, 2007

(54) RADIO FREQUENCY DETECTION AND IDENTIFICATION SYSTEM

(75) Inventors: Eric Eckstein, Merion Station, PA (US); John D. Paranzino, Sewell, NJ (US); Nimesh Shah, Marlton, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 160 days.

(21) Appl. No.: 11/123,736

(22) Filed: May 6, 2005

(65) Prior Publication Data

US 2005/0200483 A1 Sep. 15, 2005

Related U.S. Application Data

(63) Continuation of application No. 09/848,827, filed on May 4, 2001, now Pat. No. 6,894,614.

(60) Provisional application No. 60/202,391, filed on May 8, 2000.

(51) Int. Cl.
*G08B 13/14* (2006.01)

(52) U.S. Cl. ..... 340/572.1; 340/568.1; 340/505

(58) Field of Classification Search .. 340/572.1–572.9, 340/568.1, 505, 502
See application file for complete search history.

(56) References Cited

U.S. PATENT DOCUMENTS 3,913,219 A 10/1975 Lichtblau
4,023,167 A 5/1977 Wahlstrom
4,429,302 A * 1/1984 Vandebult ..... 340/572.4
4,481,428 A 11/1984 Charlot, Jr.
4,670,740 A 6/1987 Herman et al.
4,700,179 A 10/1987 Fancher
4,727,360 A 2/1988 Ferguson et al.
5,241,298 A 8/1993 Lian et al.
5,317,330 A 5/1994 Everett et al.
5,381,137 A * 1/1995 Ghaem et al. ..... 340/572.5
5,414,412 A 5/1995 Lian
5,510,769 A 4/1996 Kajfez et al.
5,517,179 A 5/1996 Charlot, Jr.
5,602,556 A 2/1997 Bowers
5,604,486 A 2/1997 Lauro et al.
5,798,693 A 8/1998 Engellenner
5,812,065 A 9/1998 Schrott et al.
5,900,816 A 5/1999 Weaver (Continued)

FOREIGN PATENT DOCUMENTS

WO WO 00/04519 1/2000

*Primary Examiner*—Daniel Wu
*Assistant Examiner*—Daniel Previl
(74) *Attorney, Agent, or Firm*—Caesar, Rivise, Bernstein, Cohen & Pokotilow, Ltd.

(57) ABSTRACT

A system is disclosed for detecting the presence of an article. The system includes a transmitter for radiating a first electromagnetic signal at a predetermined primary frequency and a resonant tag secured to the article. The resonant tag generates a second electromagnetic signal in response to receiving the first electromagnetic signal. The second electromagnetic signal has components at the primary frequency and at a predetermined secondary frequency different from the primary frequency. The system also includes a receiver for receiving the second electromagnetic signal and a computer connected to an output of the receiver. The computer processes the received second electromagnetic signal and generates an output signal when the secondary frequency is detected in the second electromagnetic signal.

25 Claims, 7 Drawing Sheets

U.S. PATENT DOCUMENTS 6,232,878 B1 5/2001 Rubin
6,598,793 B1 * 7/2003 Fisher et al. ..... 235/449
6,894,614 B2 5/2005 Eckstein et al.

* cited by examiner

RADIO FREQUENCY DETECTION AND IDENTIFICATION SYSTEM

CROSS-REFERENCE TO RELATED APPLICATIONS

This application is a Continuation application, and claims the benefit under 35 U.S.C. §120 of, application Ser. No. 09/848,827, now U.S. Pat. No. 6,894,614, filed on May 4, 2001 entitled RADIO FREQUENCY DETECTION AND IDENTIFICATION SYSTEM, which in turn claims the benefit under §119(e) of U.S. Provisional A. Ser. No. 60/202,391 filed on May 8, 2000 entitled MULTIPLE FREQUENCY TAG WITH IDENTIFICATION DATA and all of whose entire disclosures are incorporated by reference herein.

BACKGROUND OF THE INVENTION

The present invention relates generally to radio frequency systems and, more particularly, to a radio frequency system for detecting resonant tags and for ascertaining information stored in the tags.

The use of radio frequency systems for detecting and preventing theft or unauthorized removal of articles or goods from retail establishments and/or other facilities, such as libraries, has become widespread. In general, such security systems, known generally as electronic article security (EAS) systems employ a tag which is associated with or which is secured to the article to be protected. Tags may take on many different sizes, shapes and forms depending upon the particular type of EAS system in use, the type and size of the article, its packaging, etc. In general, such EAS systems are employed for detecting the presence of a tag as the protected article passes through or near a surveilled security area or zone. In most cases, the surveilled security area is located at or near an exit or entrance to the retail establishment or other facility.

One such electronic article security system which has gained widespread popularity utilizes a tag which includes a resonant circuit which, when interrogated by an electromagnetic field having prescribed characteristics, resonates at a single predetermined detection frequency. When an article having an attached resonant tags moves into or otherwise passes through the surveilled area, the tag is exposed to an electromagnetic field created by the security system. Upon being exposed to the electromagnetic field, a current is induced in the tag creating an electromagnetic field which changes the electromagnetic field created within the surveilled area. The magnitude and phase of the current induced in the tag is a function of the proximity of the tag to the security system, the frequency of the applied electromagnetic field, the resonant frequency of the tag, and the Q factor of the tag. The resulting change in the electromagnetic field created within the surveilled area because of the presence of the resonating tag can be detected by the security system. Thereafter, the EAS system applies certain predetermined selection criteria to the signature of the detected signal to determine whether the change in the electromagnetic field within the surveilled area resulted from the presence of a tag or resulted from some other source. If the security system determines that the change in the electromagnetic field is the result of the presence of a resonant tag, it activates an alarm to alert appropriate security or other personnel.

While electronic article security systems of the type described above function very effectively, a limitation of the performance of such systems relates to false alarms. False alarms occur when the electromagnetic field created within the surveilled area is disturbed or changed by a source other than a resonant tag and the security system, after applying the predetermined detection criteria, still concludes that a resonant tag is present within the surveilled area and activates an alarm, when in fact no resonant tag is actually present. Over the years, such EAS systems have become quite sophisticated in the application of multiple selection criteria for resonant tag identification and in the application of statistical tests in the selection criteria applied to a suspected resonant tag signal. However, the number of false alarms is still undesirably high in some applications. Accordingly, there is a need for a resonant tag for use in such electronic article security systems which provides more information than is provided by present resonant tags in order to assist such electronic article security systems in distinguishing signals resulting from the presence of a resonant tag within a surveilled area and similar or related signals which result from other sources.

One method of providing additional information to the EAS system is to provide a tag which responds to the interrogation signal with a signal at a different frequency than the frequency of the interrogation signal or at more than one frequency. Heretofore, single tags having one of these properties required that the tag include an active element such as a transistor, or a non-linear element, such as a rectifier or diode, both of which elements negate manufacturing the tag as a planar passive device using the technology in place for manufacturing such resonant tags.

Another method of providing additional information to the EAS system is to have two or more resonant tags, each with a different resonant frequency, secured to the article being protected. For example, the resonant frequency of a second tag could be offset from the resonant frequency of a first tag by a known amount. In this manner, the simultaneous detection of two or more signals at specific predetermined separated frequencies each having the characteristics of a resonant tag signal would have a high probability of indicating the presence of the multiple resonant tags in the surveilled area since the probability of some other source or sources simultaneously generating each of the multiple signals at each of the predetermined frequencies is very small.

The concept of utilizing a plurality of tags resonant at different frequencies on each article has not been generally accepted because of the requirement for physically separating the tags by a substantial distance in order to preclude the tags from interacting in such a way that the respective resonant frequencies are altered in an unpredictable way. Placing the resonant tags at a substantial distance from each other is disadvantageous because at best it requires separate tagging operations thereby substantially increasing the cost of applying the resonant tags. In addition, some articles are just not large enough to permit the two or more tags to be separated enough to preclude interaction. Separating the tags by a significant distance also affects the orientation and, therefore, the signal strength from the tags thereby limiting detectability of one or more of the tags.

There are also radio frequency systems, known generally as radio frequency identification (RFID) systems, which operate with resonant tags for identifying articles to which the resonant tag is attached or the destination to which the articles should be directed. The use of resonant circuit tagging for article identification is advantageous compared to optical bar coding in that it is not subject to problems such as obscuring dirt and may not require exact alignment of the tag with the tag detection system. Generally, the resonant tags used in RFID systems store information about the article by activating (or deactivating) the resonant circuit patterns which have been printed, etched or otherwise affixed to the tag. Typically, systems utilizing multiple tuned circuit detection sequentially interrogate each resonant circuit with a signal having a frequency of the resonant circuit and then wait for reradiated energy from each of the tuned circuits to be detected. The result of having to sequentially interrogate the tag at each of the different frequencies is a slow detection system that limits the speed at which the articles may be handled.

The present invention employs a tag having a plurality of resonant circuits, each of which are electromagnetically coupled to a receiving resonant circuit. Upon interrogation by a pulse at the receiving frequency, the tag radiates a detectable electromagnetic signal having frequency components which correspond to the resonant frequencies of the resonant circuits. Accordingly, the present invention is capable of reducing the false alarm rate in EAS applications without the need for separate tags with distinct frequencies being placed on an article; and also, is capable of providing information stored on the tag in RFID applications.

BRIEF SUMMARY OF THE INVENTION

Briefly stated the present invention comprises a system for detecting the presence of an article comprising: a transmitter for radiating a first electromagnetic signal at a predetermined primary frequency; a resonant tag secured to the article, for generating a second electromagnetic signal in response to receiving the first electromagnetic signal, the second electromagnetic signal being at the primary frequency and at a predetermined secondary frequency different from the primary frequency; a receiver for receiving the second electromagnetic signal; and a computer connected to an output of the receiver, said computer processing the received second electromagnetic signal and generating an output signal when the secondary frequency is detected in the second electromagnetic signal.

The present invention further comprises a radio frequency system for determining the presence of information stored in a plurality of resonant circuits having different resonant frequencies, the system comprising: a transmitter for radiating a first electromagnetic signal at a predetermined primary frequency; a resonant tag, including the plurality of resonant circuits, each of the resonant circuits resonating at one of the different resonant frequencies, the tag receiving the first electromagnetic signal and generating a second electromagnetic signal in response to receiving the first electromagnetic signal, the second electromagnetic signal comprising a plurality of secondary frequencies, each of the secondary frequencies corresponding to one of the resonant frequencies of the plurality of resonant circuits; a receiver for receiving the second electromagnetic signal; and a computer connected to the output of the receiver, said computer processing the received second electromagnetic signal to detect the presence of the plurality of secondary frequencies and generating an output signal corresponding to the information.

The present invention also comprises a method for detecting the presence of an article comprising the steps of: securing a resonant tag to the article; transmitting a first electromagnetic signal at a predetermined primary frequency; generating a second electromagnetic signal in response to the resonant tag receiving the first electromagnetic signal, the second electromagnetic signal being at the primary frequency and at a predetermined secondary frequency different from the primary frequency; receiving the second electromagnetic signal; processing the received second electromagnetic signal; and generating an output signal when the secondary frequency is detected in the second electromagnetic signal.

The present invention also comprises a method for determining the presence of information stored in a plurality of resonant circuits having different resonant frequencies, comprising the steps of: including the plurality of resonant circuits in a resonant tag; radiating a first electromagnetic signal at a predetermined primary frequency; receiving the first electromagnetic signal in the resonant tag and generating a second electromagnetic signal in response to receiving the first electromagnetic signal, the second electromagnetic signal comprising a plurality of secondary frequencies, each of the secondary frequencies corresponding to one of the resonant frequencies of the plurality of resonant circuits; receiving the second electromagnetic signal; processing the received second electromagnetic signal to detect the presence of the plurality of secondary frequencies; and generating an output signal corresponding to the information.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
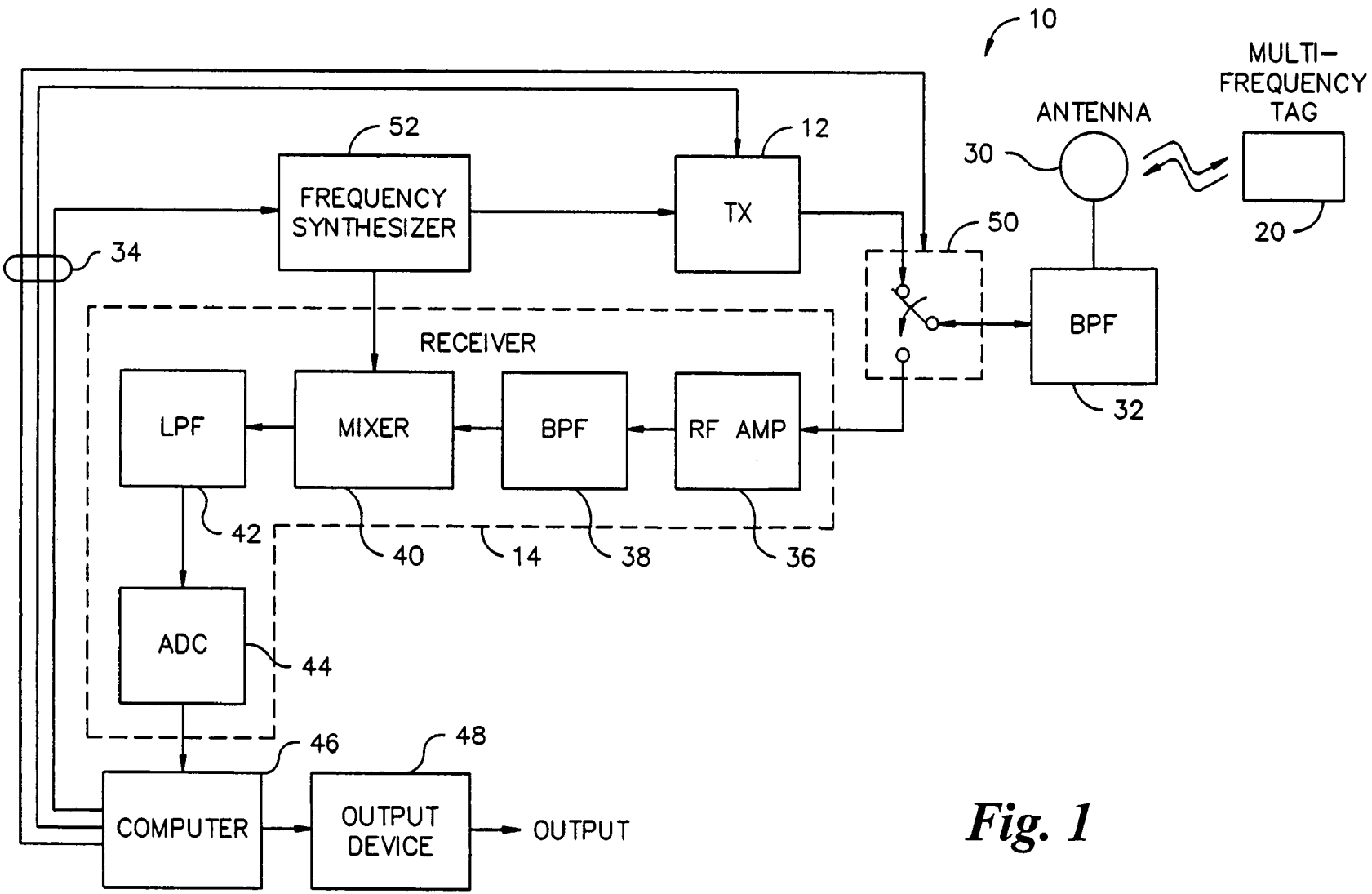
FIG. 1 is a schematic block diagram of a radio frequency detection and identification system in accordance with a preferred embodiment of the invention.

Referring to the drawings, wherein the same reference numeral designations are applied to corresponding elements throughout the figures, there is shown in FIG. 1 a schematic block diagram of a preferred embodiment of an RF system 10 for detecting an article and/or for identifying information about the article upon which a tag having specific electromagnetic characteristics has been attached. Preferably, the RF system 10 is of a type called a pulse-listen system, in which pulses of radio frequency (RF) electromagnetic energy having a predetermined pulse width, pulse rate and carrier frequency are radiated into a detection and identification zone. Following the radiation of each pulse into the detection and identification zone, the RF system 10 probes the electromagnetic field within the zone to determine if a tag having the specific electromagnetic characteristics is present in the detection and identification zone.

Preferably, the RF system 10 includes a transmitter 12 for radiating a first electromagnetic signal at one or more predetermined primary frequencies. Preferably the transmitter 12 includes a push-pull class D RF amplifier of a conventional design generating a pulse amplitude modulated signal having a pulse duration of approximately five (5) microseconds and having a carrier frequency in the range of 13.5 MHz. However, as would be appreciated by one skilled in the art, the carrier frequency of the output signal of the transmitter 12 is not limited to 13.5 MHz. As contemplated, a transmitter operable at carrier frequencies as low as 1.5 MHz and as high as 7000 MHz. would be within the spirit and scope of the invention. Further, the pulse width of the pulse amplitude modulated signal is not limited to five (5) microseconds. As would be appreciated by those skilled in the art, the pulse width of the transmitter 12 would be selected to match the characteristics of the specific tag used in the RF system 10, such design choice being within the spirit and scope of the invention.

The preferred embodiment also includes a frequency synthesizer 52. Preferably, the frequency synthesizer is a digital frequency synthesizer similar to the digital frequency synthesizer described in allowed U.S. patent application Ser. No. 09/315,452 entitled "Resonant Circuit Detection and Measurement System Employing a Numerically Controlled Oscillator", now U.S. Pat. No. 6,232,878 which is hereby incorporated by reference in its entirety. The frequency synthesizer 52 provides a first output signal for driving the transmitter 12 at the primary frequency. The frequency synthesizer 52 also provides a second output signal for driving a conventional mixer 40 portion of a superhetrodyne receiver 14. The frequency of the second output signal of the frequency synthesizer 52 may be the same as the primary frequency or may be different from the primary frequency (i.e. a secondary frequency) depending on the selected mode of operation of the RF system 10, as discussed below.

The RF system 10 also includes a dual-resonant tag 20 for receiving a first electromagnetic signal from the transmitter 12 and for generating a second electromagnetic signal in response to receiving the first electromagnetic signal. The second electromagnetic signal comprises a frequency component which corresponds to the primary frequency of the first electromagnetic signal and also a secondary frequency component which corresponds to a predetermined secondary frequency which is different from the primary frequency.

Figure 2:
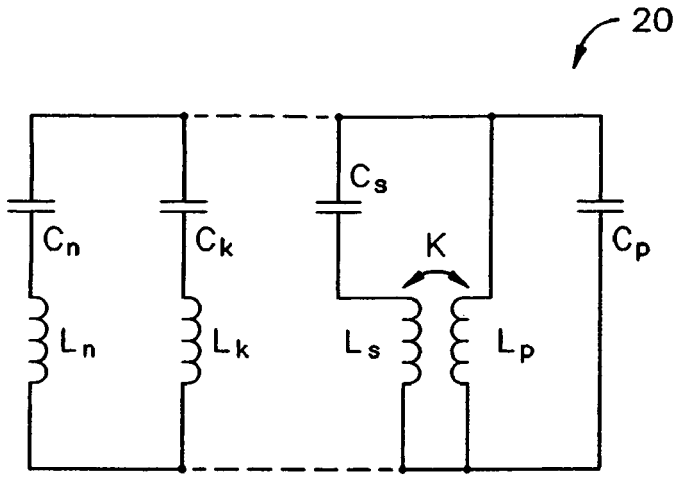
FIG. 2 is an electrical schematic circuit diagram of a dual-frequency resonant tag in accordance with a preferred embodiment.

Referring now to FIG. 2 there is shown an electrical schematic representation of a dual frequency tag 20 in accordance with a first preferred embodiment of the present invention. The dual frequency tag 20 includes four components namely, a first inductive element or inductance Lp, a second inductive element or inductance Ls, a first capacitive element or capacitance Cp and a second capacitive element or capacitance Cs. The aforementioned inductors and capacitors form a first resonant circuit which is resonant at the primary frequency and a second resonant circuit which is resonant at the second frequency. Preferably the first and the second resonant circuits are electromagnetically coupled. Additional inductive and/or capacitive elements or components may be added if desired as shown by the dashed lines in FIG. 2, and the components Lk, Ln and Ck, Cn to form additional resonant circuits which are electromagnetically coupled to the first magnetic circuit. As shown in FIG. 2 the second inductance Ls is connected in series with the second capacitance Cs. The first capacitance Cp is connected in parallel with the first inductance Lp. The series network (Ls and Cs) is then connected across the parallel network (Lp and Cp). Preferably, the inductors Lp and Ls are magnetically coupled to each other with a coupling coefficient K. However, the coupling of the first and second resonant circuits may also be accomplished by capacitive or resistive coupling. The values of the inductances Lp, Ls, the capacitances Cp, Cs and the coupling coefficient K are selected so that the dual frequency tag 20 as configured in FIG. 2 is simultaneously resonant at the first and second resonant frequencies.

Preferably, the resonant frequency of the first resonant circuit lays in an Industrial, Scientific and Medical (ISM) frequency band as assigned by the International Telecommunications Union (ITU). Current ISM assigned bands include frequency bands at 13, 27, 430–460, 902–916 and 2350–2450 MHz. Preferably, the resonant frequency of the second resonant circuit lays within a frequency band assigned to EAS systems, currently including approximately 1.95, 3.25, 4.75 and 8.2 MHz. In the preferred embodiment the resonant frequency of the first resonant circuit is at about 13.56 MHz. and the resonant frequency of the second resonant circuit is at about 8.2 MHz. Methods for selecting the values of the inductances and the capacitances to meet the frequency requirements of the dual frequency tag 20 are well known to those of ordinary skill in the art and need not be described herein for a complete understanding of the present invention. The capacitances can be lumped or distributed within the inductances as will hereinafter be described.

Figure 3:
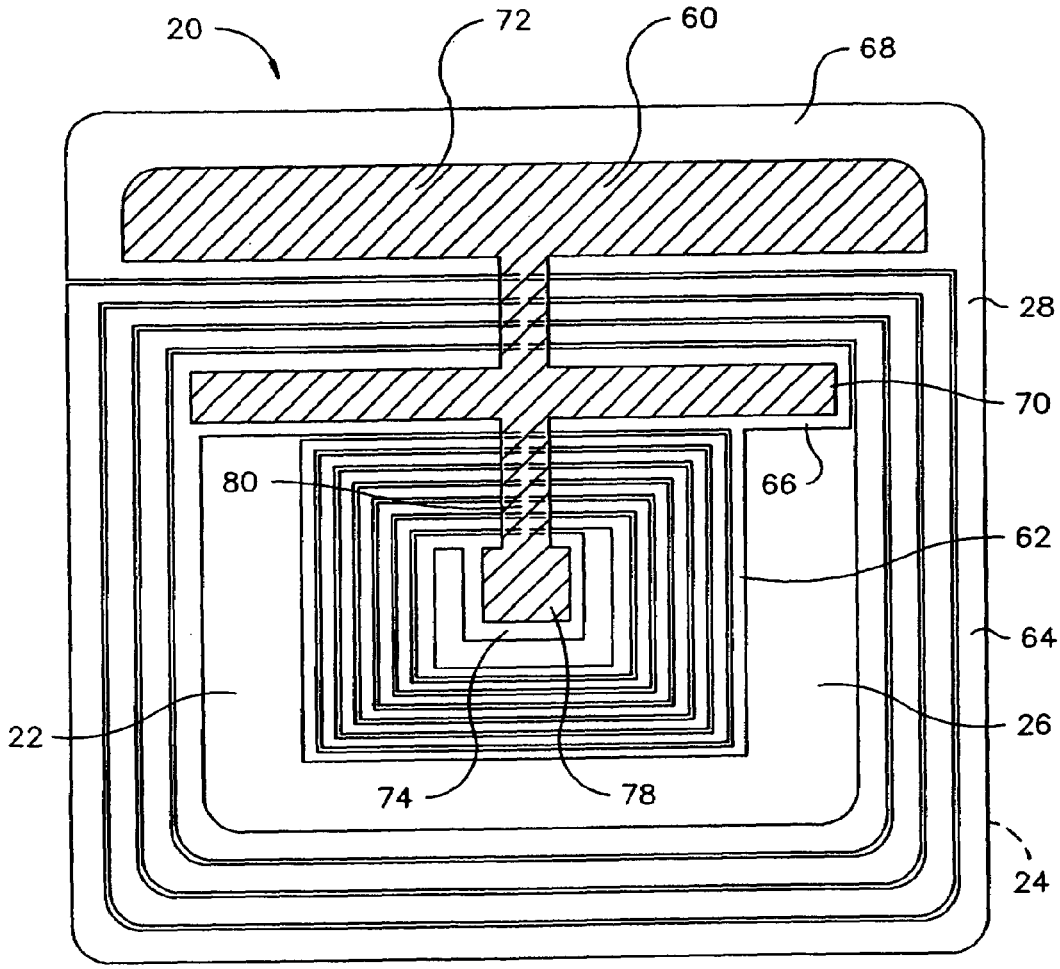
FIG. 3 is a top plan view of a dual-frequency resonant tag having an electrical circuit equivalent to the electrical schematic circuit diagram of FIG. 2.

FIG. 3 is a top plan view of the dual frequency tag 20 in accordance with the electrical circuit shown in FIG. 2. The dual frequency tag 20 is comprised of a substantial planar dielectric substrate 22 having a first principal surface or side 24 and a second, opposite principal surface or side 26. The substrate 22 may be constructed of any solid material or composite structure or other materials as long as the substrate is insulative, relatively thin and can be used as a dielectric. Preferably, the substrate 22 is formed of an insulated dielectric material, for example, a polymeric material such as polyethylene. However, it will be recognized by those skilled in the art that other dielectric materials may alternatively be employed in forming the substrate 22. As illustrated in FIG. 3, the substrate 22 is transparent. However, transparency is not a required characteristic of the substrate 22.

The circuit components of the tag 20 as previously described are formed on both principal surfaces or sides 24, 26 of the substrate 22 by patterning a conductive material. That is, a first conductive pattern 28 (shown in the lighter color of FIG. 3) is formed on the first side 24 of the substrate 22 which is arbitrarily illustrated in FIG. 3 as the bottom or backside of the tag 20. A second conductive pattern 60 (shown in the darker color on FIG. 3) is formed on the second side 26 of the substrate 22. The conductive patterns 28, 60 may be formed on the substrate surfaces 24, 26, respectively with electrically conductive materials of a known type and in a manner which is well known to those of skill in the electronic article surveillance art. Preferably, the conductive material is patterned by a subtractive process (i.e., etching) whereby unwanted material is removed by chemical attack after the desired material has been protected, typically with a printed on etch resistant ink. In the preferred embodiment, the conductive material is aluminum. However, other conductive materials (e.g., gold, nickel, copper, bronzes, brass, high density graphite, silver-filled conductive epoxies or the like) can be substituted for the aluminum without changing the nature of the tag 20 or its operation. Similarly, other methods (dye cutting or the like) may be employed for forming the conductive patterns 28, 60 on the substrate 22. The tag 20 may be manufactured by a process of the type described in U.S. Pat. No. 3,913,219, entitled "Planar Circuit Fabrication Process" which is incorporated herein by reference. However, other manufacturing processes can be used if desired.

As previously stated, the first and second conductive patterns 28, 60 together form the resonant circuit as discussed above. In the embodiment as shown in FIG. 3, both of the inductances or inductive elements Lp and Ls are provided in the form of conductive coils 62, 64 respectively, both of which are a part of the first conductive pattern 28. Accordingly, both of the inductances Lp and Ls are located on the first side 24 of the substrate 22. Preferably, the two conductive coils 62, 64 are wound in the same direction, as shown, to provide a specified amount of inductive coupling between them. In addition, first plates 66, 68 of each of the capacitive elements or capacitances Cp and Cs are formed as part of the first conductive pattern 28 on the first side 24 of the substrate 22. Finally, second plates 70, 72 of each of the capacitances Cp and Cs are formed as part of the second conductive pattern 60 and are located on the second side 26 of the substrate 22. Preferably, a direct electrical connection extends through the substrate 22 to electrically connect the first conductive pattern 28 to the second conductive pattern 60 to thereby continuously maintain both sides of the substrate 22 at substantially the same static charge level. Referring to FIG. 3, the first conductive pattern 28 includes a generally square land 74 on the inner most end of the coil portion 62, which forms the first inductance Lp. Likewise, a generally square land 78 is formed as part of the second conductive pattern 60 and is connected by a conductive beam 80 to the portion of the second conductive pattern 60, which forms the second plate 70 of the first capacitance Cp. As shown in FIG. 3 the conductive lands 74, 78 are aligned with each other. The direct electrical connection is made by a weld through connection (not shown), which extends between conductive land 74 of the first conductive pattern 28 and conductive land 78 of the second conductive pattern 60. Preferably, the direct electrical connection between the lands 74, 78 is formed by a weld in a manner which is well known to those of ordinary skill in the EAS art.

Figure 5:
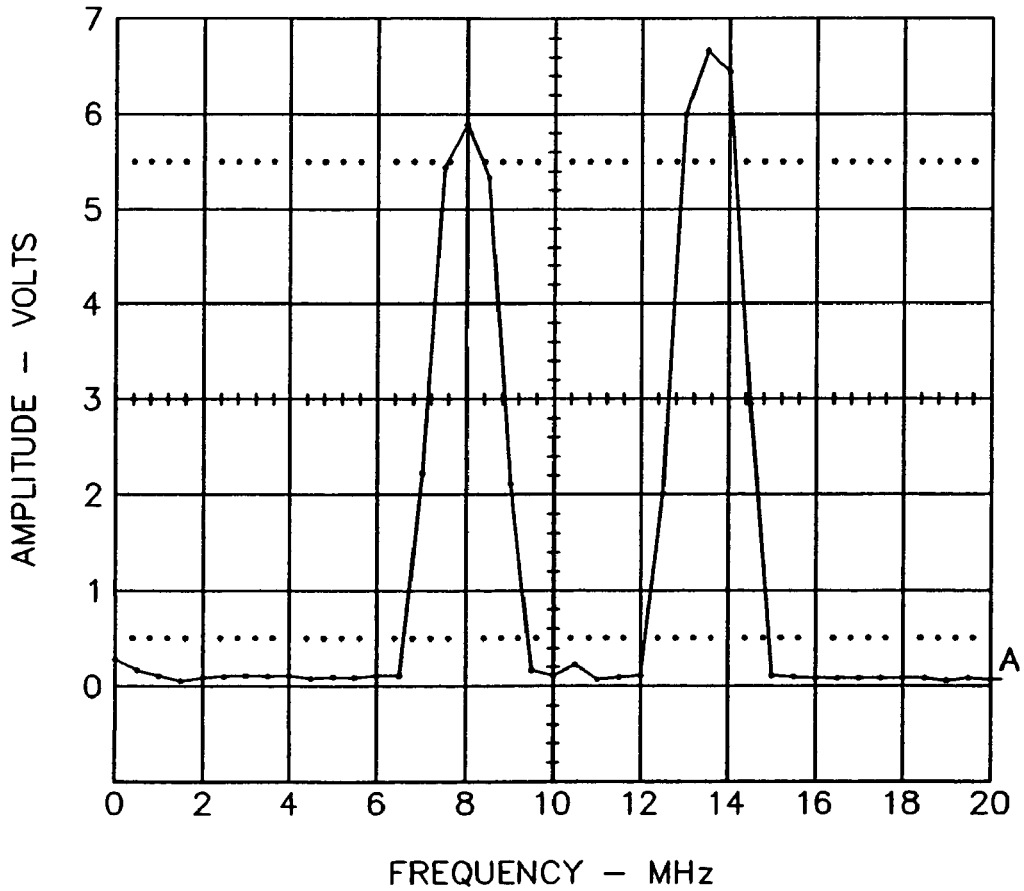
FIG. 5 is a plot of the frequency domain response of the prototype of the circuit of FIG. 2.
Figure 4:
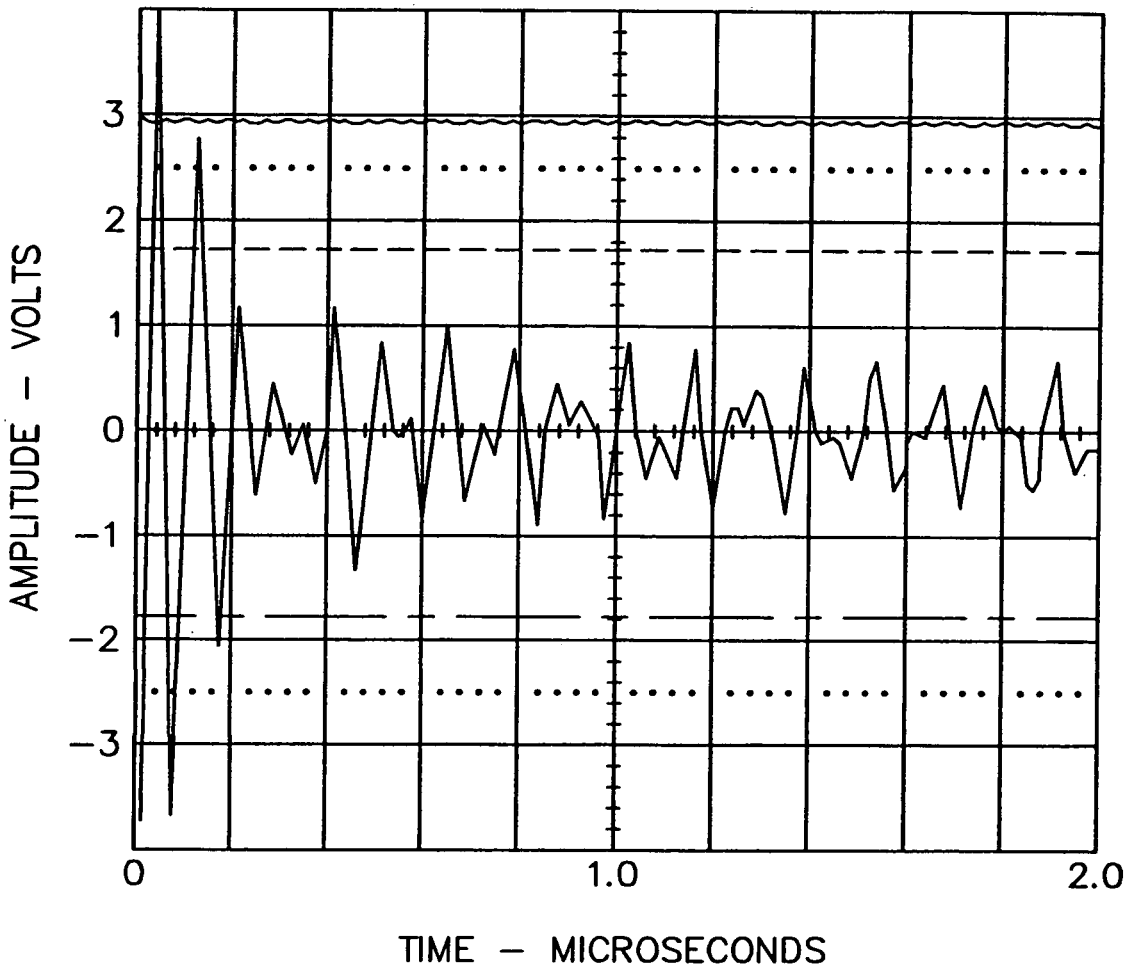
FIG. 4 is a plot of the time domain response of a prototype of the circuit of FIG. 2.

Referring now to FIG. 4 there is shown a plot of the transient response of a prototype of the preferred embodiment of the dual frequency tag 20 after being radiated with a pulsed electromagnetic field having a five (5) microsecond pulse width and a carrier frequency of 13.56 MHz. The prototype was designed to simultaneously resonate at both 13.56 MHz. and at 8.2 MHz. The prototype tag was placed at the center of a rectangular loop antenna fabricated from one (1) inch copper tape and was radiated by applying a radio frequency (RF) signal to the antenna. A probe connected to an oscilloscope was used to measure the residual (ring-down) electromagnetic field in the vicinity of the prototype tag when the transmitted signal was switched off. FIG. 4 clearly shows the presence of at least two frequency components in the time-domain ring-down signal. The time domain signal shown in FIG. 4 was subsequently transformed into the frequency domain by operating on the signal data with a fast Fourier transform (FFT). The result of applying the FFT to the data of FIG. 4 is shown in FIG. 5, in which obvious peaks in the frequency spectrum are shown at about 13.56 MHz. and at about 8.2 MHz.

The preferred embodiment of the RF system 10 also includes a superhetrodyne receiver 14 of conventional design for receiving the second electromagnetic signal from an antenna 30 via an antenna switch 50 and a bandpass filter 32, and for converting the received RF signal to a baseband signal. The receiver comprises an RF amplifier 36, a band pass filter 38, the mixer 40, a low pass filter 42 and an analog-to-digital converter 44. The RF amplifier 36 and the band pass filter 38 have a bandwidth for covering the range of the signals desired to be detected. In the preferred embodiment, RF amplifier 36 and the bandpass filter have a bandwidth extending from about 5.0 MHz. to about 15.0. MHz. The bandpass characteristic of the RF amplifier 36 and the bandpass filter 38 could be a single substantially flat bandpass characteristic, a characteristic of multiple pass bands, or could be tunable to a plurality of narrower bandwidths depending on the design needs.

Preferably, the output of the bandpass filter 38 is connected to the mixer 40. The mixer 40 receives the output signal from the bandpass filter 38 and the second output signal from the frequency synthesizer 52 and converts the frequency of the output signal of the bandpass filter 38 to a baseband signal by multiplying together the output signal of the bandpass filter 38 and the second output signal of frequency synthesizer 52. The output of the mixer 40 is filtered by the low pass filter 42 prior to applying the baseband signal to the analog-to-digital converter 44. The analog-to-digital converter 44 converts the analog baseband signal to a digital signal compatible with an input to a computer 46. As will be appreciated by those skilled in the art, the receiver 14 is not limited to accepting an input signal extending from about 5.0 MHz. to about 15.0. MHz. As contemplated, a receiver capable of receiving frequencies as low as 1.5 MHz and as high as 7000 MHz. is within the spirit and scope of the invention.

The RF system further includes an antenna 30 for radiating the first electromagnetic signal and for providing the second electromagnetic signal received from the tag 20 to the receiver 14. Preferably, the antenna is a loop antenna which provides a detection and identification zone in the near field proximate to the antenna 30 and generally provides for cancellation of the electromagnetic field in the far field. A suitable antenna is that disclosed in U.S. Pat. No. 5,602,556 entitled "Transmit and Receive Loop Antenna" which is hereby incorporated by reference in its entirety. However, other types of antennas could be used. The antenna 30 is connected to the transmitter 12 by the antenna switch 50 when the transmitter 12 is transmitting the first electromagnetic signal, i.e. during the "pulse period" and is connected to the receiver 14 when it is desired to receive the second electromagnetic signal, i.e. during the "listen" period.

The preferred embodiment of the RF system 10 further includes a computer 46 connected to an output of the receiver 14. The computer 46 processes the received second electromagnetic signal and generates an output signal when a signature of the received second electromagnetic signal meets a predetermined criterion. As discussed below, the criteria for generating the output signal may include the detection of the secondary frequency alone or may include the detection of both the primary frequency and the secondary frequency. Such processing for detecting the presence of resonant tags is well known to those skilled in the art and is not further disclosed here, for the sake of brevity. The computer 46 also provides the overall timing and control for the RF system 10. Preferably, the computer 46 comprises a commercially available digital signal processor computer chip selected from a family such as the TMS320C54X, available from Texas Instruments Corporation, volatile random access memory (RAM) and non-volatile read only memory (ROM). Computer executable software code stored in the ROM and executing in the computer chip and in the RAM controls the RF system 10 by providing control signals over control wires 34 to control the frequency of the frequency synthesizer 52, the pulse width of the output signal of the transmitter 12 and the position of the antenna switch 50.

Figure 6:
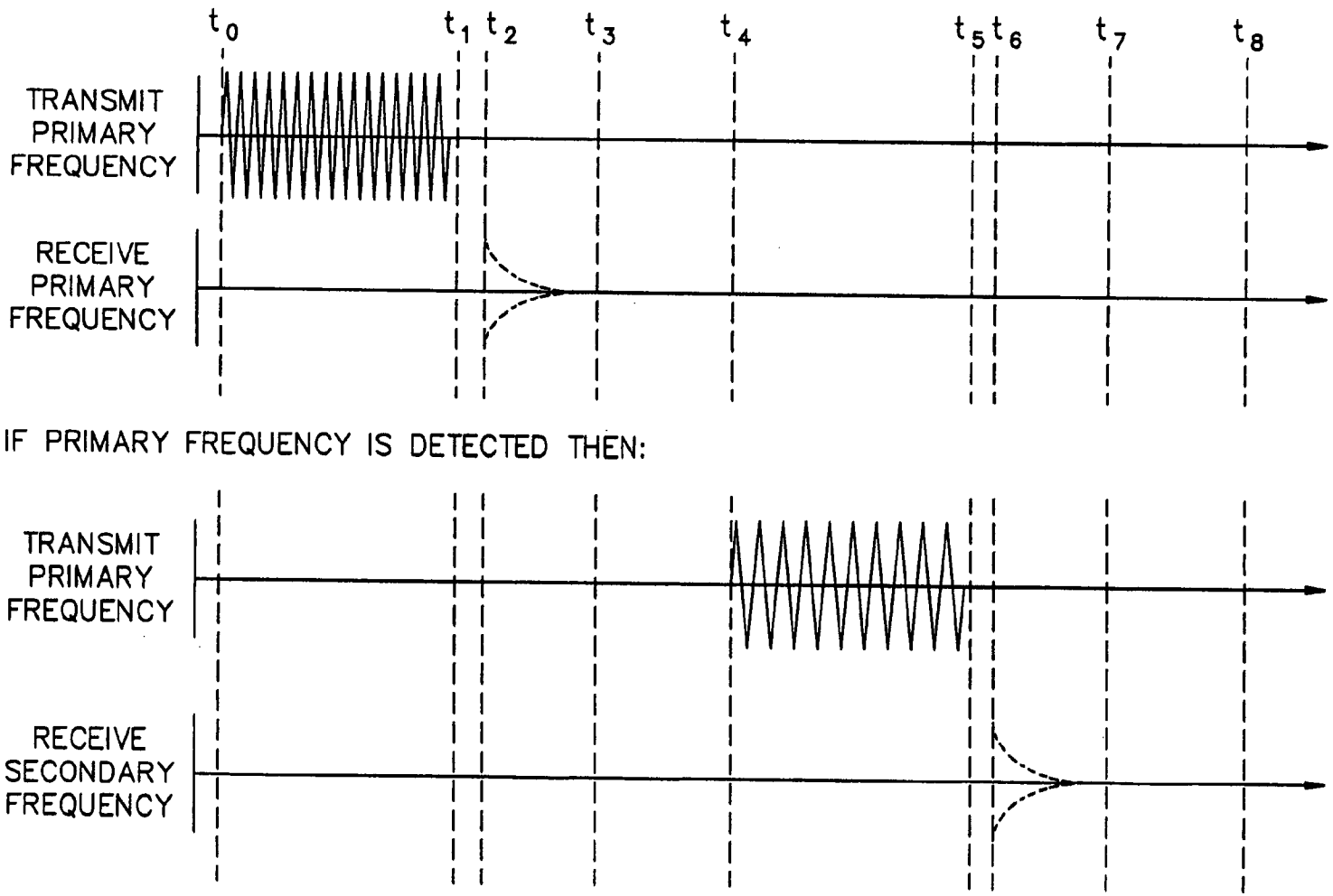
FIG. 6 is a diagram illustrating the interrogation and response characteristics of the radio frequency system of FIG. 1.
Figure 7:
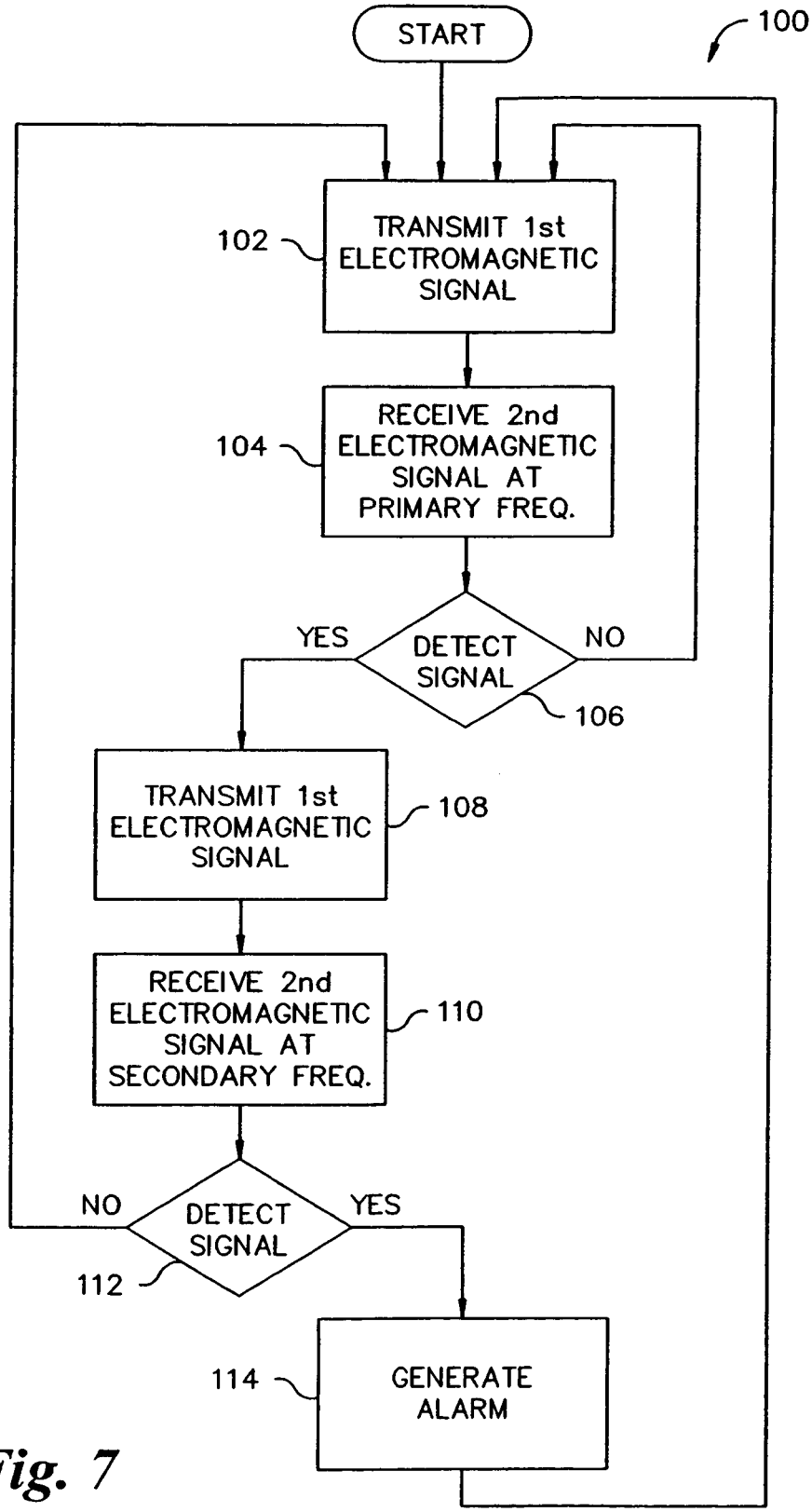
FIG. 7 is a flow diagram of the operation of the radio frequency system for detecting the presence of an article.

Referring now to FIGS. 6 and 7 there are shown a timing diagram and an accompanying flow chart of a process 100 illustrating the operation of the RF system 10 for detecting a resonant tag 20 having two electromagnetically coupled resonant circuits, in accordance with the preferred embodiment. At times $t_0$ to $t_1$ (step 102), the computer 46 controls the frequency synthesizer 52 to generate a signal at the primary frequency, controls the antenna switch 50 to connect the transmitter 12 to the antenna 30 and gates the transmitter 12 on to generate a pulse of RF energy to form the first electromagnetic signal at the predetermined primary frequency. From times $t_2$ to $t_3$ (step 104), the computer 46 controls the antenna switch 50 to connect the antenna 30 to the receiver 14, thereby preparing the receiver 14 to receive the second electromagnetic signal at the primary frequency. The second electromagnetic signal received by the receiver 14 at the primary frequency is processed by the computer 46 (step 106) to determine if the signal meets a predetermined criteria which characterizes the resonant tag 20 ring-down signal at the primary frequency, such criteria being stored in the computer 46. If the stored criteria for the ring-down signal is met by the received signal, the computer 46 retransmits the first electromagnetic signal at the primary frequency at times $t_4$ to $t_5$ (step 108). If the ring-down signal does not meet the predetermined criteria, step 102 is repeated. At times $t_6$ to $t_7$ (step 110), the computer 46 controls the frequency synthesizer 52 to generate a signal at the predetermined secondary frequency and controls the antenna switch 50 to connect the receiver 14 to the antenna 30 to prepare the receiver for receiving the second electromagnetic signal at the secondary frequency. The second electromagnetic signal received by the receiver 14 at the secondary frequency is processed by the computer 46 (step 112) to determine if the signal meets a predetermined criteria, also stored in the computer 46, which characterizes the resonant tag 20 ring-down signal at the secondary frequency. If the stored criteria for the ring-down signal at the secondary frequency is met by the received signal, the computer 46 generates an alarm indicating the presence of a resonant tag 20 within the detection zone (step 114). If the ring-down signal does not meet the predetermined criteria, the process of detecting the resonant tag 20 returns to step 102.

As will be appreciated by those skilled in the art, detecting the ring-down signals from the resonant tag 20 at both the primary frequency and the secondary frequency substantially reduces the false alarm rate for an EAS system operating in an interference environment. However, as will be further appreciated by those skilled in the art, it is not necessary to detect the primary frequency and the secondary frequency components of the second electromagnetic signal sequentially, as described in the preferred embodiment. The primary and the secondary frequencies could be also be detected simultaneously based on a single transmission of the primary frequency. Further, detection of the resonant tag 20 by detecting only the primary frequency or only the secondary frequency alone is, possible and is within the spirit and scope of the invention.

In practice, the resonant frequencies of the resonant circuits which comprise the resonant tag 20 have manufacturing tolerances which may result in the frequencies of the ring-down frequencies deviating from the predetermined primary and secondary frequencies sufficiently to degrade detection of the resonant tag 20. Preferably, the first resonant circuit of the resonant tag 20 is trimmed by a laser or other means so that the resonant frequency of the first resonant circuit is acceptably close to the predetermined primary frequency. In this case, the bandwidth of the receiver may be made narrow for detecting the primary frequency and wide for detecting the secondary frequency to allow for the tolerances of the second resonant circuit at the secondary frequency. Alternatively, the second resonant circuit may also be trimmed to be close to the predetermined secondary frequency.

In the cases where the first and/or the second resonant circuit of the resonant tag 20 have an uncertainty of the resonant frequency which is undesirably large compared to the maximum acceptable RF bandwidth of the receiver 14, the following alternatives are feasible:

a. Scan the frequency of the first electromagnetic signal over the uncertainty range of the first resonant circuit, as is commonly done for pulse-listen type of EAS systems; when a detection at the primary frequency is indicated, re-transmit the first electromagnetic signal at the indicated primary frequency and detect the second electromagnetic signal at the secondary frequency by: (1) employing an RF bandwidth in the receiver 14 which covers the uncertainty range of the second resonant circuit, (2) using a parallel bank of filters, such as provided by an FFT to cover the uncertainty range of the second resonant circuit, or (3) continually retransmitting the primary frequency and scanning the uncertainty range of the second resonant circuit.

b. Scan the frequency of the first electromagnetic signal over the uncertainty range of the first resonant circuit; for each transmission of the primary frequency: detect the second electromagnetic signal at the secondary frequency by: (1) employing an RF bandwidth in the receiver 14 which covers the uncertainty range of the second resonant circuit, (2) using a parallel bank of filters, such as provided by an FFT to cover the uncertainty range of the second resonant circuit, or (3) continually retransmitting the primary frequency and scanning the uncertainty range of the second resonant circuit.

The present invention is not limited to merely detecting the presence of a resonant tag 20 in a detection zone by detecting the ring-down of one or two resonant circuits as for an EAS surveillance function. The present invention also includes within its scope a radio frequency identification (RFID) capability which employs a single tag having two or more resonant circuits, (see FIG. 2), with each resonant circuit being designed to resonate at a different frequency. Such a tag would have a single first resonant circuit resonant at a primary frequency and a plurality of second resonant circuits, each of which second resonant circuits resonating at a different frequency and each of such second resonant circuits being electromagnetically coupled to the first resonant circuit. For example, the resonant tag 20 could include a first resonant circuit at the primary frequency and four different second resonant circuits, each resonating at a different resonant frequency within the detection range of associated equipment. By identifying the particular frequencies at which the various resonant circuits of the tag resonate, it is possible to obtain identification information from the tag.

In the presently preferred embodiment, the preferred detection frequency range extends from about 10 MHz to about 30 MHz. However, any other frequency range could be used. Using state of the art manufacturing equipment, it is possible to produce, in commercial quantities, an inexpensive radio frequency identification tag having two or more resonant circuits thereon to establish a unique signature with the resonant frequency of each resonant circuit being controllable so that the resonant circuit resonates at a predetermined frequency with an accuracy of plus or minus 200 KHz. In this manner, within the detection frequency range of 10–30 MHz, it is possible to have up to 50 resonant circuits, each of which resonates at a different frequency without overlapping or interfering with one another. Thus, assuming a tag with four separate resonant circuits, the first resonant circuit could resonate at a first selected frequency within the detection frequency range, for example, 14.4 MHz leaving 49 available frequencies within the detection frequency range for the other three resonant circuits of the tag. The second resonant frequency could then be selected to resonate at a second frequency within the detection frequency range, for example, 15.6 MHz leaving 48 possible frequencies for the other two resonant circuits of the tag. The third resonant frequency could be selected and the tag fabricated to resonate at a third frequency, for example, 20 MHz leaving 47 possible frequencies for the fourth resonant frequency. The fourth resonant frequency could then be selected and the tag fabricated to resonate at a fourth frequency, for example, 19.2 MHz. A tag having four specifically identified resonant frequencies and a unique signature when interrogated could then be assigned a particular identification number. Because of the number of potential frequencies within the detection frequency range, a tag having four resonant circuits thereon, each with a different frequency, is capable of having approximately, 5.2 million combinations or approximately 22 bits of data.

Figure 8:
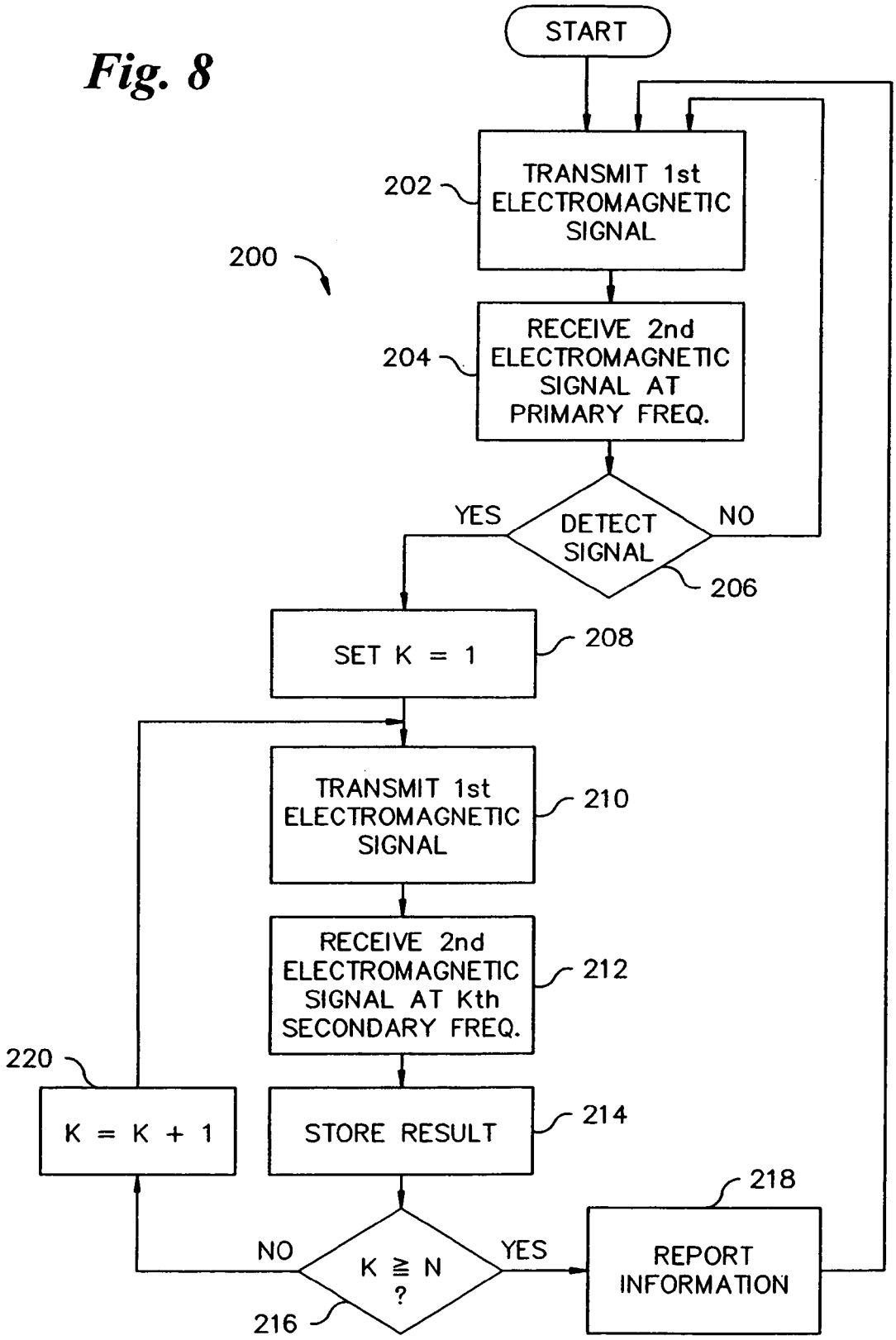
FIG. 8 is a flow diagram of the operation of the radio frequency system for determining the presence of information stored in a plurality of resonant circuits.

FIG. 8 is a flow diagram of a preferred process 200 for using the RF system 10, as shown in FIG. 1, for identifying the resonant frequencies of the RFID tag by interrogating the tag at the primary frequency of the RFID tag and by detecting the presence or absence of a predetermined ring-down signature at each of N secondary resonant frequencies. At step 202 the computer 46 controls the frequency synthesizer 52 to generate a signal at the primary frequency, controls the antenna switch 50 to connect the transmitter 12 to the antenna 30 and gates the transmitter 12 on to generate a pulse of RF energy to form the first electromagnetic signal at the predetermined primary frequency. At step 204, the computer 46 controls the antenna switch 50 to connect the antenna 30 to the receiver 14, thereby preparing the receiver 14 to receive the second electromagnetic signal at the primary frequency. The second electromagnetic signal received by the receiver 14 at the primary frequency is processed by the computer 46 (step 206) to determine if the signal meets a predetermined criteria which characterizes the resonant tag 20 ring-down signal at the primary frequency, such criteria being stored in the computer 46. If the stored criteria for the ring-down signal is met by the received signal, the computer 46 sets a counter to the integer number "one" (step 208) and retransmits the first electromagnetic signal at the primary frequency (step 210). At step 212, the computer 46 controls the frequency synthesizer 52 to generate a signal at the Kth predetermined secondary frequency and controls the antenna switch 50 to connect the receiver 14 to the antenna 30 to prepare the receiver for receiving the second electromagnetic signal at the Kth secondary frequency. The second electromagnetic signal received by the receiver 14 at the secondary frequency is processed to determine if the signal meets the predetermined ring-down signature criteria and a result of the processing is stored by the computer 46 (step 214). At step 216 the current value of the counter is compared with the number "N" which represents the number of secondary frequencies to be received. If the value K of the counter is less than N, the process 200 is continued at step 210. If the value K of the counter is equal to N the process 200 is completed by reporting which secondary frequencies were received having the predetermined ring-down signature (step 218), and the RFID process 200 is started again at step 202.

In summary, the present invention provides a system and a method for interrogating a resonant tag at a single (primary) frequency and for receiving information stored in the tag by one or more resonant circuits which are resonant at frequencies other than the primary frequency. Accordingly, the present invention provides a means for reducing the false alarm rate of an EAS system and a means for interrogating an RFID tag to receive information stored in the tag by radiating electromagnetic energy at only the single (primary) frequency.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claim.

The invention claimed is:

1. A system for detecting the presence of an article comprising:

a transmitter for radiating a first electromagnetic signal at a predetermined primary frequency;

a tag comprising at least one generally planar conductive pattern, said tag being arranged to be secured to the article for generating a second electromagnetic signal in response to receiving the first electromagnetic signal, the second electromagnetic signal being at the primary frequency and at a predetermined secondary frequency, different from the primary frequency;

a receiver for receiving the second electromagnetic signal; and a computer connected to an output of the receiver, said computer processing the received second electromagnetic signal and generating an output signal when the secondary frequency is detected in the second electromagnetic signal.

2. The system according to claim 1, wherein said at least one generally planar conductive pattern comprises a first resonant circuit for resonating at the primary frequency and a second resonant circuit for resonating at the secondary frequency, the first and the second resonant circuits being electromagnetically coupled.

3. The system according to claim 2, wherein the first resonant circuit energizes at least one other resonant circuit.

4. The system according to claim 2, wherein the excitement of the second resonant circuit is dependent upon the excitement of the first resonant circuit.

5. The system according to claim 1, wherein the first electromagnetic signal is pulse amplitude modulated.

6. The system according to claim 1, wherein the receiver also detects the primary frequency and generates an output signal only when the primary and the secondary frequencies are both detected.

7. The system according to claim 6, wherein the receiver is tuned successively to the primary frequency and to the secondary frequency.

8. The system according to claim 1, wherein the primary and the secondary frequencies are not harmonically related to each other.

9. The system according to claim 1, wherein the tag is of a passive type which includes only inductive and capacitive elements.

10. The system according to claim 1, wherein the transmitter is a non-sweeping transmitter.

11. The system according to claim 1, wherein the transmitter is not transmitting a signal when the receiver receives a signal.

12. The system according to claim 1, wherein the receiver receives only a natural function signal, said natural function signal originating only from an energized circuit.

13. The system according to claim 1, wherein the receiver does not receive a forcing function signal from an energized circuit.

14. A system for determining the presence of information stored in a plurality of resonant frequency circuits having different resonant frequencies, the system comprising:

a transmitter for radiating a first electromagnetic signal at a predetermined primary frequency;

a tag including the plurality of resonant circuits, each of which comprises a generally planar conductive pattern on the tag and each of the resonant circuits resonating at one of the different resonant frequencies, said tag receiving the first electromagnetic signal and generating a second electromagnetic signal in response to receiving the first electromagnetic signal, the second electromagnetic signal comprising a plurality of secondary frequencies, each of the secondary frequencies corresponding to one of the resonant frequencies of the plurality of resonant circuits;

a receiver for receiving the second electromagnetic signal; and a computer connected to the output of the receiver, said computer processing the received second electromagnetic signal to detect the presence of the plurality of secondary frequencies and generating an output signal corresponding to the information.

15. The system according to claim 14, wherein the tag comprises a first resonant circuit and a plurality of second resonant circuits, each of the plurality of second resonant circuits being electromagnetically coupled to the first resonant circuit.

16. The system according to claim 14, wherein the first electromagnetic signal is pulse amplitude modulated.

17. The system according to claim 14, wherein the tag is of a passive type which includes only inductive and capacitive elements.

18. A method for detecting the presence of an article comprising the steps of:

securing a tag, having a plurality of resonant circuits each of which comprises a generally planar conductive pattern on the tag, to the article;

transmitting a first electromagnetic signal at a predetermined primary frequency;

generating a second electromagnetic signal in response to the resonant tag receiving the first electromagnetic signal, the second electromagnetic signal being at the primary frequency and at a predetermined second frequency different from the primary frequency;

receiving the second electromagnetic signal; and processing the received second electromagnetic signal and generating an output signal when the secondary frequency is detected in the second electromagnetic signal.

19. The method of claim 18, wherein the first electromagnetic signal is pulse amplitude modulated.

20. The method according to claim 18, further including the step of detecting the primary frequency and generating an output signal only when the primary and the secondary frequencies are both detected.

21. The method according to claim 20, wherein the primary frequency and the secondary frequency are detected successively.

22. A method for determining the presence of information stored in a plurality of resonant circuits having different resonant frequencies, comprising the steps of:

providing a tag including the plurality of resonant circuits each of which comprises a generally planar conductive pattern;

radiating a first electromagnetic signal at a predetermined primary frequency;

receiving the first electromagnetic signal by the resonant tag and generating a second electromagnetic signal in response to receiving the first electromagnetic signal, the second electromagnetic signal comprising a plurality of secondary frequencies, each of the secondary frequencies corresponding to one of the resonant frequencies of the plurality of resonant circuits;

receiving the second electromagnetic signal; and processing the received second electromagnetic signal to detect the presence of the plurality of secondary frequencies and generating an output signal corresponding to the information.

23. The method of claim 22, wherein the first electromagnetic signal is pulse amplitude modulated.

24. A system for detecting the presence of an article comprising:

a transmitter for radiating a first electromagnetic signal at only a predetermined primary frequency;

a tag, having a plurality of resonant circuits each of which comprises a generally planar conductive pattern on the tag, and being arranged to be secured to the article for generating a second electromagnetic signal in response to receiving said first electromagnetic signal, said second electromagnetic signal being at said primary frequency and at a predetermined secondary frequency, different from said primary frequency;

a receiver for receiving said second electromagnetic signal; and a computer connected to an output of the receiver, said computer processing the received second electromagnetic signal and generating an output signal when said secondary frequency is detected in said second electromagnetic signal.

25. The system according to claim 24, wherein said receiver does not listen for said second electromagnetic signal at the same frequency as the frequency of said first electromagnetic signal.

* * * * *